US010454155B2

(12) United States Patent
Choon et al.

(10) Patent No.: US 10,454,155 B2
(45) Date of Patent: Oct. 22, 2019

(54) ANTENNA MODULE AND MOBILE TERMINAL USING SAME

(71) Applicants: Tan Yew Choon, Singapore (SG); Ng Guan Hong, Singapore (SG); Tay Yew Siow, Singapore (SG)

(72) Inventors: Tan Yew Choon, Singapore (SG); Ng Guan Hong, Singapore (SG); Tay Yew Siow, Singapore (SG)

(73) Assignee: AAC Technologies Pte. Ltd., Singapore (SG)

( * ) Notice: Subject to any disclaimer, the term of this patent is extended or adjusted under 35 U.S.C. 154(b) by 54 days.

(21) Appl. No.: 15/283,539

(22) Filed: Oct. 3, 2016

(65) Prior Publication Data

US 2017/0117615 A1 Apr. 27, 2017

(30) Foreign Application Priority Data

Oct. 26, 2015 (CN) ..... 2015 1 0700339

(51) Int. Cl.

| | |
|---|---|
| ***H01Q 1/24*** | (2006.01) |
| ***H01Q 9/04*** | (2006.01) |
| ***H01Q 13/10*** | (2006.01) |
| ***H01Q 5/328*** | (2015.01) |

(52) U.S. Cl.

CPC ..... *H01Q 1/243* (2013.01); *H01Q 5/328* (2015.01); *H01Q 9/0457* (2013.01); *H01Q 13/103* (2013.01)

(58) Field of Classification Search

CPC ..... H01Q 9/0442; H01Q 9/42; H01Q 9/0457; H01Q 13/103; H01Q 13/10; H01Q 13/106; H01Q 5/371; H01Q 7/005; H01Q 5/328; H01Q 9/0407; H01Q 9/26; H01Q 3/247; H01Q 1/243

See application file for complete search history.

(56) References Cited

U.S. PATENT DOCUMENTS

| | | | | |
|---|---|---|---|---|
| 9,614,282 | B1 * | 4/2017 | Zheng | H01Q 7/005 |
| 2004/0147297 | A1 * | 7/2004 | Mikkola | H01Q 1/243 455/575.7 |
| 2005/0219128 | A1 * | 10/2005 | Tan | H01Q 1/243 343/702 |
| 2008/0291111 | A1 * | 11/2008 | Bae | H01Q 1/243 343/860 |

(Continued)

*Primary Examiner* — Ricardo I Magallanes
(74) *Attorney, Agent, or Firm* — IPro, PLLC; Na Xu

(57) ABSTRACT

An antenna module is disclosed. The antenna module includes a radiator. The radiator includes a first radiation part, a second radiation part connecting with the first radiation part partially and a coupling slot arranged between the first radiation part and the second radiation part. Further, the antenna module includes a circuit board which is arranged opposite to the radiator and includes a system base, a grounding line connecting with the system base electrically, a feeder line and a tuning switch controlling ON/OFF of the grounding line, and a capacitance feed sheet facing one side of the first radiation part which faces the circuit board and connecting with the first radiation part. The capacitance feed sheet is connected with the feeder line electrically; the grounding line is connected with the first radiation part electrically; and the system base is connected with the said second radiation part electrically.

10 Claims, 6 Drawing Sheets

(56) References Cited

U.S. PATENT DOCUMENTS

| | | | | |
|---|---|---|---|---|
| 2013/0027254 | A1* | 1/2013 | Korva | H01Q 7/00 343/702 |
| 2014/0368407 | A1* | 12/2014 | Azulay | H01Q 1/243 343/905 |
| 2016/0164168 | A1* | 6/2016 | Choi | H01Q 1/48 343/702 |

* cited by examiner

ANTENNA MODULE AND MOBILE TERMINAL USING SAME

FIELD OF THE INVENTION

The invention is related to the field of antenna technology, especially to a low-frequency antenna.

DESCRIPTION OF RELATED ART

The mobile terminal devices, such as the mobile phone, the tablet PC, the portable multimedia player, etc. have been applied in people's lives along development of radio communication technology. The internal parts of the mobile terminal devices shall support the radio communication functions by transmitting radio signals by means of an antenna module which is configured normally and widely.

More and more metal housings, such as the metal rear cover, the metal frame, have been applied to the mobile terminal devices, such as the intelligent mobile phones, etc. in order to perfect and improve the degree of firmness of the whole product; while more and more modes of the mobile terminal devices are required to cover, such as GSM/DCS/PCS/WCDMA/TD-SCDMA/LTE, etc. along development of the mobile communication technology as a result of narrow frequency band and low efficiency because certain shielding or absorption effect to the electromagnetic wave may be generated by the metal housing; and the different frequency bands shall be taken for the different mobile communication modes.

In accordance with relevant technology, the antenna should be installed outdoors or the antenna shall not be surrounded by the metal housing by using the special design as for the mobile terminal device; however, this method may limit the frequency band of the antenna because the radiation space of the antenna might be limited on one hand, and on the other hand, may affect the overall appearance of the mobile terminal device.

Therefore, it is necessary to provide a novel antenna module to solve the above-mentioned technical problem.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
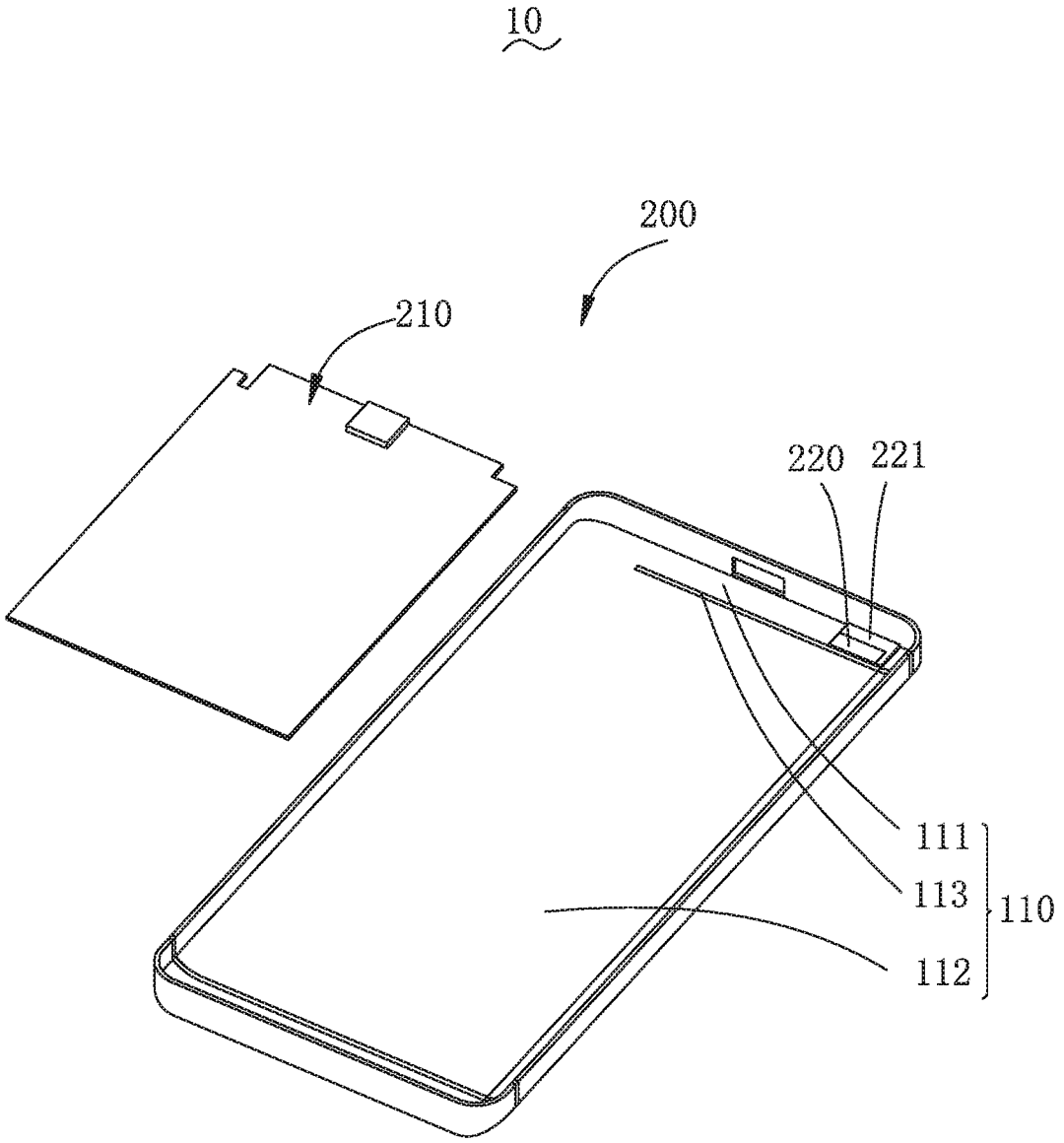
FIG. 1 is a partially exploded view of a mobile terminal in accordance with an exemplary embodiment of the present disclosure.
Figure 2:
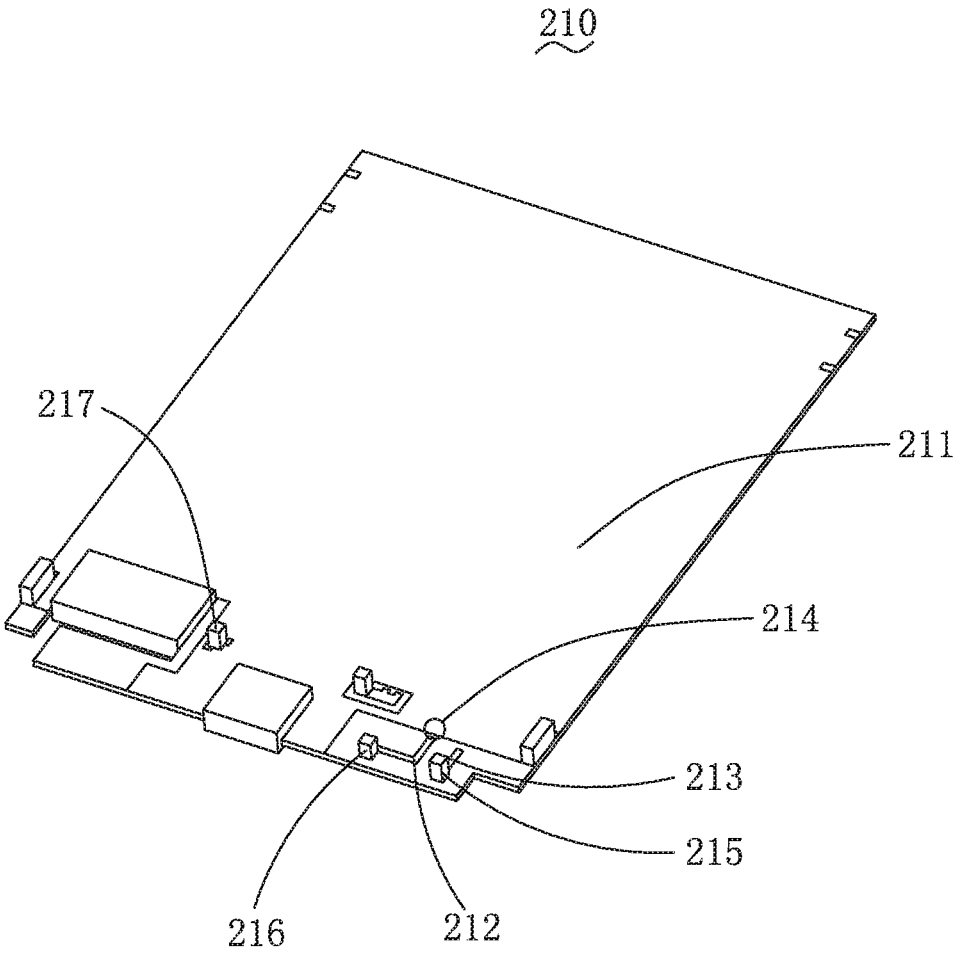
FIG. 2 is an illustration of a back of a circuit board in FIG. 1.

Referring to FIGS. 1-2, a mobile terminal device 10 can be a mobile phone, a tablet PC or other mobile terminals to which an antenna module 200 provided. Specifically, the mobile terminal device 10 comprises a metal rear cover 110 and an antenna module 200. In the disclosure, the metal rear cover 110 shall be taken as the radiator 110 of the antenna module 200, that is, the metal rear cover 110 serves as a radiator. The antenna module 200 also comprises a circuit board 210 and a capacitance feed sheet 220 which are arranged opposite to the radiator 110 and arranged with interval prescribed.

The radiator 110 is presented as a cuboid box approximately, including a first radiation part 111, a second radiation part 112 connecting with the first radiation part 111 partially and a coupling slot 113 arranged between the first radiation part 111 and the second radiation part 112. In this embodiment, the first radiation part 111 and the second radiation part 112 are the identical metal plate which is cut into two radiation parts by using the coupling slot 113 extending transversely (that is, the short-side direction of the metal rear cover 110); however, the two radiation parts at the place where the slot does not run through are connected with each other because the slot does not run through the metal plate completely along the transverse direction. The metal rear cover is beautiful and the radiation parts can be ensured to connect with each other by using such a structure. Moreover, plastic substance can be filled in the coupling slot 113 in this embodiment.

The capacitance feed sheet 220 is arranged on one side of the first radiation part 111 which faces the circuit board 210 and is non-electrically connected with the first radiation part 111. Specifically, the capacitance feed sheet 220 is arranged at the position far from the connecting position of the first radiation part 111 and the second radiation part 112. In this embodiment, the antenna module 200 comprises a plastic installation member 221 for installing the capacitance feed sheet 220. The plastic installation member 221 is fixed on the first radiation part 111 by means of adhesion, embedding, etc. The capacitance feed sheet 220 can be formed on the external surface of the plastic installation member 221 facing the circuit board 210 by printing, laser direct forming, etc. The plastics serving as the plastic installation member 221 and the plastic to be filled in the slot 113 can be the same material. In this embodiment, the plastic installation member 221 shall be about 0.5 mm thick. Moreover, the power can be fed to the radiator 110 by using capacitance feed sheet 220 in presence of the coupled feeding effect of capacitance when the radiation frequency of the antenna module is 700 MHz due to the structure in which this capacitance feed sheet 220 is connected with the first radiation part 111 in the insulated manner.

The circuit board 210 comprises a system base 211 for grounding the mobile terminal, a grounding line 212 installed on one side of the circuit board 210 facing the radiator 110 and arranged opposite to the first radiation part 111 and a feeder line 213 connecting with the power line of the mobile terminal electrically and feeding the power supply to the antenna module 200. The feeder line 213 and the capacitance feed sheet 220 are arranged to be opposed to each other. The circuit board 210 further comprises a tuning switch 214 connecting between the system base 211 and the grounding line 212 electrically and controlling ON/OFF of the grounding line 212. In this embodiment, the feeder line 213 directly contacts with the capacitance feed sheet 220 through a first pin 215, therefore the electric connection with the capacitance feed sheet 220 can be implemented; the grounding line 212 directly contacts with the first radiation part 111 through a second pin 216, therefore the electric connection with the first radiation part 111 can be implemented. The system base 211 directly contacts with the second radiation part 112 by a third pin 217, therefore the electric connection with the second radiation part 112 can be implemented. In this embodiment, the distance prescribed between the circuit board and the radiator shall be the length of the second pin or the third pin; and the first pin, the second pin and the third pin can be the contact structures of pogo pin or other springs. The stable grounding of the radiation parts can be ensured by connecting the system base 211 with the second radiation part 112 by using more pins at other positions.

Figure 3:
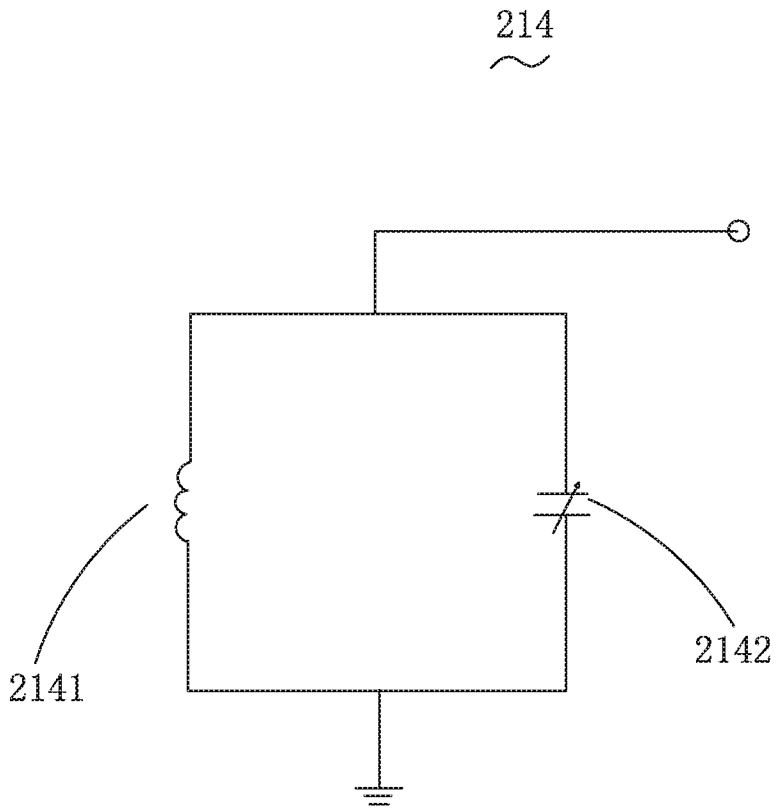
FIG. 3 is a circuit diagram of a tuning switch of the mobile terminal in FIG. 1.

The tuning switch 214 involves the tunable LC resonant circuit, as shown in FIG. 3; and the resonant circuit is connected between the system base and the grounding line and comprises a fixed inductor 2141 and a tunable capacitor 2142 which are arranged abreast. Moreover, the antenna module can be adjusted step by step between the power-on state and the capacitor state by adjusting the capacitance of the tunable capacitor 2142 step by step.

Figure 4:
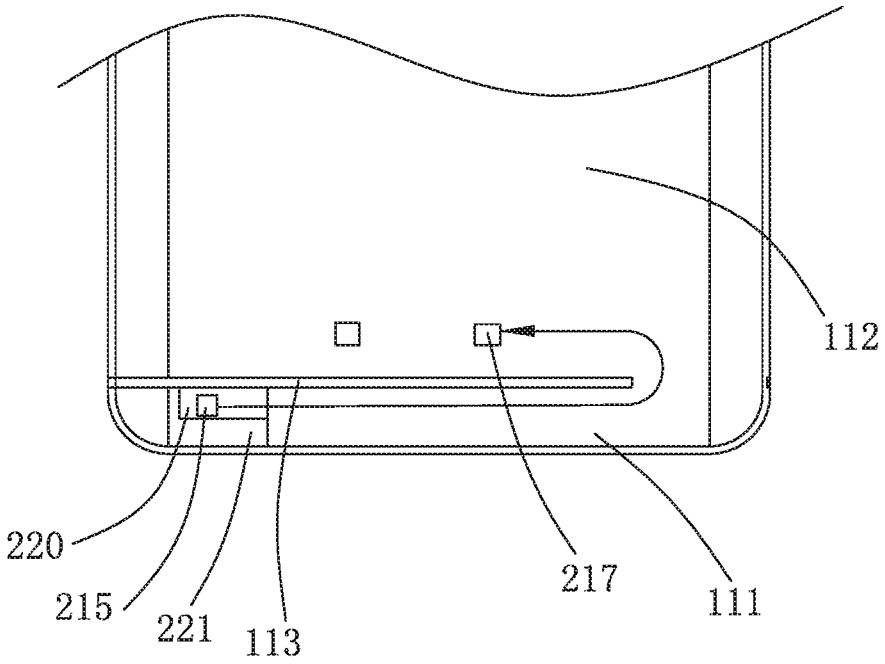
FIG. 4 is a sketch map of the current trend of an antenna module of the mobile terminal at frequency band of 700 MHz.

The current can be delivered to the capacitance feed sheet 220 by the first pin 215 when the capacitance of the tunable capacitor 2142 is great, as shown in FIG. 4. The energy of the capacitance feed sheet 220 shall be coupled to the first radiation part 111 by using the coupled feeding effect of capacitance, and the current can be delivered to the third pin 217 along the direction indicated by the arrow shown in FIG. 4. Therefore, the loop of the antenna can be formed, and the radiation frequency of the antenna is 700 MHz.

Figure 5:
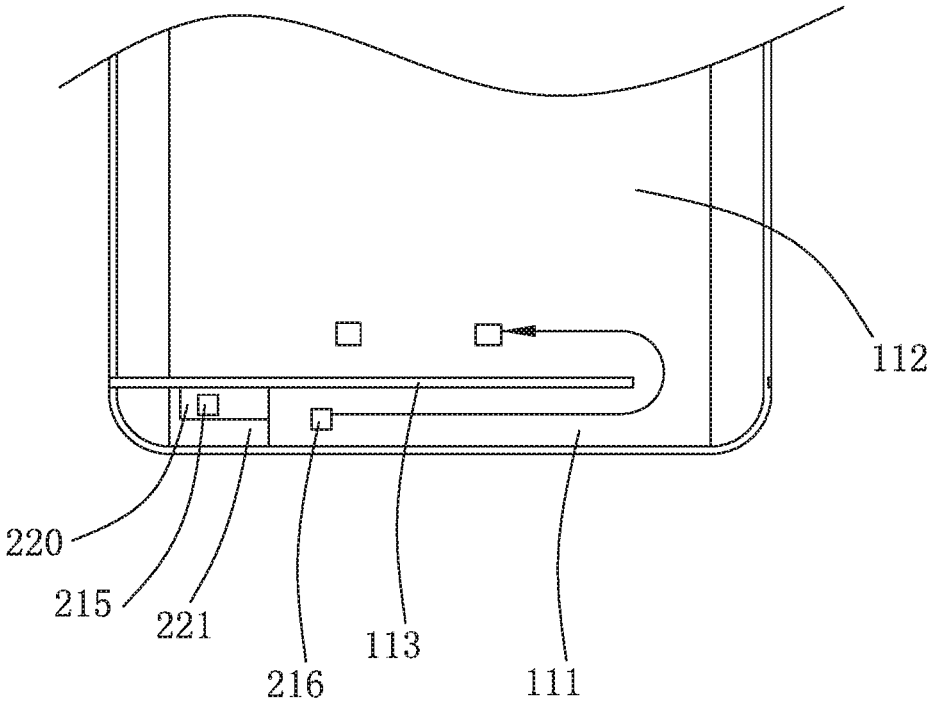
FIG. 5 is a sketch map of the current trend of the antenna module of the mobile terminal at the frequency band of 900 MHz.

The current can be delivered to the capacitance feed sheet 220 by using the first radiation part 111 directly when the capacitance of the tunable capacitor 2142 is low, as shown in FIG. 5; and the current can be delivered to the third pin 217 along the direction indicated by the arrow shown in FIG. 5. Therefore, another loop of the antenna can be formed, and the radiation frequency of the antenna is 960 MHz.

Figure 6:
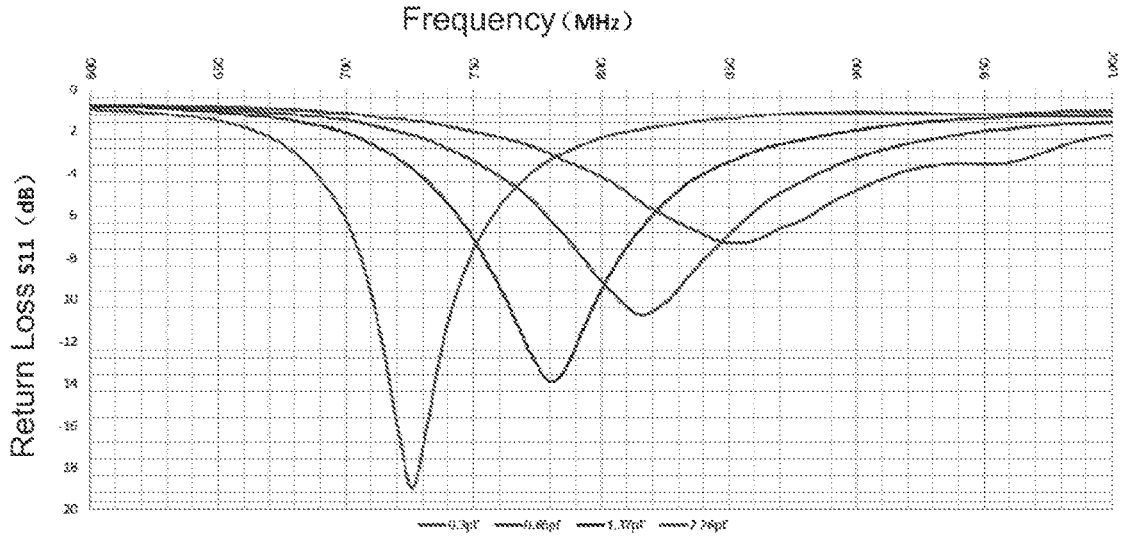
FIG. 6 shows return loss of the antenna module of the mobile terminal at different capacitances.

The return loss of the antenna module are shown in FIG. 6 at different capacitances (0.3 pF, 0.66 pF, 1.37 pF and 2.26 pF). From the figure, the radiation frequency of the antenna module is positioned in the region of 900 MHz when the capacitance is low; and the radiation frequency shall be changed into the low-frequency region gradually and positioned in the region of 700 MHz finally when the capacitance is increased gradually.

Figure 7:
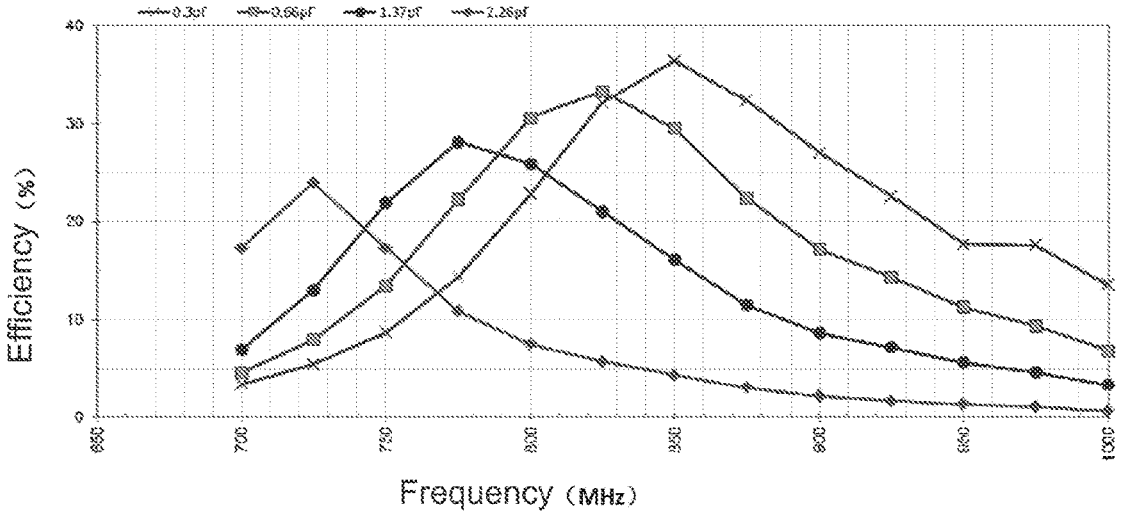
FIG. 7 shows efficiency curves of the antenna module of the mobile terminal at different capacitances.

The efficiencies of the antenna module at different capacitances are shown in the FIG. 7 from which the efficiencies are better within the frequency band of 824 MHz-960 MHz when the capacitance is low and improved within the frequency band of 700 MHz-800 MHz when the capacitance is great. Moreover, taking the capacitances 0.66 pF and 1.37 pF as examples, the efficiencies within the frequency band of 700 MHz-960 MHz are optimized, as shown in FIG. 7.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna module, including:

a radiator comprising a first radiation part, a second radiation part connected with the first radiation part partially, and a coupling slot extending straightly and arranged between the said first radiation part and the said second radiation part;

a circuit board arranged opposite to the said radiator, the circuit board including a system base, a grounding line connecting with the system base electrically, a feeder line and a tuning switch controlling the grounding line;

a capacitance feed sheet facing one side of the first radiation part which faces the circuit board and non-electrically connecting with the first radiation part, the capacitance feed sheet being connected with the feeder line electrically; wherein the grounding line is connected with the first radiation part electrically to; and the system base is connected with the said second radiation part electrically;

the portion of the first radiation part where the grounding line is connected electrically to and the portion of the second radiation part where the system base is connected electrically to locate on the two opposite sides of the coupling slot.

2. The antenna module as described in claim 1, wherein the tuning switch is a tunable LC resonant circuit which is connected between the system base and the grounding line electrically.

3. The antenna module as described in claim 2, wherein the LC resonant circuit includes a fixed inductor and a tunable capacitor connected in parallel.

4. The antenna module as described in claim 1 further comprising a plastic installation member installed on the first radiation part; the capacitance feed sheet being fixed on an external surface of the plastic installation member facing the circuit board.

5. The antenna module as described in claim 1, wherein the feeder line directly contacts with the capacitance feed sheet by a first pin.

6. The antenna module as described in claim 5, wherein the grounding line directly contacts with the first radiation part by a second pin.

7. The antenna module as described in claim 6, wherein the system base directly contacts with the second radiation part by a third pin.

8. The antenna module as described in claim 1, wherein the radiation frequency of the said antenna module ranges from 700 MHz to 960 MHz.

9. A mobile terminal, comprising a metal rear cover and an antenna module as described in claim 1, wherein the metal rear cover serves as a radiator of the antenna module.

10. The antenna module as described in claim 7, wherein current flows along different routines when the antenna module radiates at different radiation frequency, the current flows from a portion corresponding to the first pin along the edge of the coupling slot to the third pin when the antenna module radiates at one radiation frequency and the current flows form a portion corresponding to the second pin along the edge of the coupling slot to the third pin when the antenna module radiates at another radiation frequency.

* * * * *